US012396567B2

(12) United States Patent
Grutta

(10) Patent No.: US 12,396,567 B2
(45) Date of Patent: Aug. 26, 2025

(54) REMOTELY CONTROLLING BEDS

(71) Applicant: Purple Innovation, LLC, Lehi, UT (US)

(72) Inventor: James T. Grutta, Draper, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 18/389,527

(22) Filed: Nov. 14, 2023

(65) Prior Publication Data

US 2024/0074591 A1 Mar. 7, 2024

Related U.S. Application Data

(63) Continuation of application No. 17/348,513, filed on Jun. 15, 2021, now Pat. No. 11,812,856.

(60) Provisional application No. 63/039,281, filed on Jun. 15, 2020.

(51) Int. Cl.
*A47C 19/22* (2006.01)
*A47C 31/00* (2006.01)

(52) U.S. Cl.
CPC ..... *A47C 19/22* (2013.01); *A47C 31/008* (2013.01)

(58) Field of Classification Search
None
See application file for complete search history.

(56) References Cited

U.S. PATENT DOCUMENTS 5,605,235 A 2/1997 Johnson
7,284,791 B1 10/2007 Wright
2009/0126115 A1 5/2009 Doering et al.
2014/0197666 A1 7/2014 Koch
2014/0331405 A1 11/2014 Wetmore
2015/0131781 A1 5/2015 Ohashi et al.
2015/0196147 A1* 7/2015 Jensen ..... A47G 9/04 5/498
2015/0342361 A1 12/2015 Shih
(Continued)

FOREIGN PATENT DOCUMENTS

JP H08-32270 B2 3/1996
KR 2020010000351 U 1/2001
(Continued)

OTHER PUBLICATIONS

USPTO acting as International Searching Authority, "International Search Report and Written Opinion," International Application No. PCT/US2021/037492, Nov. 4, 2021.
(Continued)

*Primary Examiner* — Adam C Ortiz
(74) *Attorney, Agent, or Firm* — Foley & Lardner LLP

(57) ABSTRACT

Apparatuses, systems, and methods for integrating remote controls into beds include a support for a remote control and an optional cradle. The support may be secured to the bed at a location where it is readily accessible to an individual as he or she lies on the bed. The support may receive the cradle or the remote control. The cradle, if any, may receive the remote control. The cradle may include a secondary remote system that may enable an individual to control certain functions of the bed, accessories thereto, and/or the environment in which the bed is located. Methods for securing and controlling a bed, any accessories, and the environment in which the bed is located are also disclosed.

19 Claims, 2 Drawing Sheets

(56) References Cited

U.S. PATENT DOCUMENTS

| | | | | |
|---|---|---|---|---|
| 2016/0242564 | A1* | 8/2016 | Cass | A47C 21/00 |
| 2017/0112716 | A1 | 4/2017 | Rawls-Meehan | |
| 2017/0221350 | A1 | 8/2017 | Hille | |
| 2017/0318982 | A1 | 11/2017 | Campbell et al. | |
| 2020/0074826 | A1* | 3/2020 | Grant | G08B 21/0247 |
| 2020/0275785 | A1 | 9/2020 | Cutler | |
| 2020/0305609 | A1* | 10/2020 | Rains | A47C 7/54 |
| 2021/0365170 | A1* | 11/2021 | Mullet | G08C 17/02 |

FOREIGN PATENT DOCUMENTS

| | | | |
|---|---|---|---|
| KR | 10-2007-0055900 | A | 5/2007 |
| KR | 1020070055900 | | 5/2007 |
| KR | 20130072233 | A | 7/2013 |

OTHER PUBLICATIONS

European Patent Office, "Extended European search report," European Application No. 21825484.5, Jun. 10, 2024.
Canadian Intellectual Propery Office, "Examiner's Requisition," Canadian Patent Application No. 3,176,413, Apr. 10, 2024.
Korean Intellectual Property Office, "Notice of Preliminary Rejection," Korean Patent Application No. 10-2022-7045911, Mar. 28, 2024.

* cited by examiner

REMOTELY CONTROLLING BEDS

CROSS-REFERENCE TO RELATED APPLICATION

This application is a continuation of U.S. patent application Ser. No. 17/348,513, filed on Jun. 15, 2021 and titled REMOTELY CONTROLLING BEDS ("the '513 application"), now U.S. Pat. No. 11,812,856, issued Nov. 14, 2023, which claims priority to the Jun. 15, 2020 filing date of U.S. Provisional Patent Application No. 63/039,281, titled REMOTELY CONTROLLING BEDS ("the '281 Provisional application"), pursuant to 35 U.S.C. § 119(e). The entire disclosure of the '513 Application and the '281 Provisional application is hereby incorporated herein.

TECHNICAL FIELD

This disclosure relates generally to remote controls for beds and, more specifically, to apparatuses and methods for integrating remote controls into beds. The remote controls and apparatuses and methods of this disclosure may be used with a variety of beds, including, without limitation, beds with adjustable bedframes, beds with inflatable mattresses, ventilated beds, and the like. In addition, the remote controls and apparatuses of this disclosure may be used to control the environment (e.g., bedroom, etc.) within which a bed is located.

RELATED ART

Advancements in sleep technology have resulted in bedframes, mattresses, and accessories that enable individuals to tailor their sleep experience. As a few examples, sleeping positions, the firmness of a mattress, the temperature of the mattress, ventilation between the mattress and bedding that covers an individual laying on the mattress, and other factors may be customized to a particular individual's needs or preferences.

The customizable features of a bed may be controlled in a variety of different ways. Conventionally, wired controllers were associated with the bed (e.g., the bedframe, mattress, accessory, etc.) in a manner that enabled an individual sitting or laying on the bed to adjust one or more customizable features of the bed. The presence of wires or cords around a bed can be unsightly and dangerous.

Remote controls have eliminated the undesirable wires and cords of conventional wired controllers. However, remote controls can add to the clutter on a nightstand next to the bed, get lost in the bed covers, which may disrupt an individual's sleep if he or she rolls onto the remote while sleeping, or require a caddy that diminishes the overall aesthetics of the bed.

Smartphones and other personal electronic devices that execute apps that enable them to be used to control the features of so-called smart beds have eliminated the need for extra devices (e.g., wired controllers, remote controls, etc.). Nevertheless, personal electronic devices have the same disadvantages as remote controls. For example, they can add to the clutter on a nightstand, get lost in the bed covers, or require the unattractive attachment of a caddy to the bedframe or headboard. The use of a smart phone to control one or more features of a bed may result in the added irritation of providing audible alarms (e.g., emergency alerts, notification chimes, phone call rings, etc.) and "silent," but still audible, vibrating alarms while an individual rests or sleeps.

SUMMARY

Apparatuses, systems, and methods for remotely controlling beds are disclosed. Such apparatuses, systems, and methods include or employ a remote control, or a primary remote system. The remote control may enable an individual to remotely operate one or more functions of a bed, such as the orientations of an adjustable base of the bed and of a mattress on the adjustable base, a firmness of the mattress, and/or temperature(s) of various portions of the mattress (e.g., its head end, its middle, its foot end, etc.). The remote control may comprise a dedicated remote control, which may control one or more functions of the bed, accessories to the bed, and, optionally, devices near the bed (e.g., lights, door locks, window blinds, etc.). Alternatively, the remote control may comprise a smart phone or another personal electronic device executing an app that enables the personal electronic device to communicate with the bed and enables an individual using the app on the personal electronic device to control one or more functions of the bed and, optionally, other devices associated with or located near the bed.

In one aspect, this disclosure relates to apparatuses and systems that secure the remote control (e.g., a dedicated remote control, a smart phone, etc.) to a bed without distracting from the aesthetic appearance of the bed. Such an apparatus may include a support. In some embodiments, the support may have a configuration that enables it to receive a cradle for a remote control. Thus, a system that secures a remote control to a bed may include the support and a cradle. In other embodiments, the support may have a configuration that enables it to directly receive a remote control. In still other embodiments, a support may have a configuration that enables it to selectively receive a remote control or a cradle for a remote control.

The support, which may also be referred to as a "base module," may be securable to a mattress of the bed at a location that is readily accessible to an individual laying on the mattress, but that does not interfere with the individual's ability to restfully sleep on the mattress or diminish the overall appearance of the mattress or the bed of which the mattress is a part.

In some embodiments, the support may be permanently affixed to the mattress. For example, the support may be permanently affixed to a location on the mattress that will not flex or otherwise distort with a change in the orientation, pressurization, etc., of the mattress (e.g., locations near the center of the length of a head section, an intermediate section, or a foot section of the mattress, etc.). More specifically, the support may be permanently affixed to a portion of a side of the mattress that does not flex or change shape as adjustments are made to the orientation, pressurization, etc., of the mattress.

In other embodiments, the support may be removably securable to one or more predetermined, or fixed, locations of the mattress. A removable support may be securable to one or more locations on the mattress that will not flex or otherwise distort when adjustments are made to the orientation, pressurization, etc., of the mattress, such as one or more locations on a side of a cover of the mattress (e.g., locations near the center of the length of a head section, an intermediate section, or a foot section of the mattress, etc.). The support may be removably received by a receptacle on the side of the cover of the mattress. As a non-limiting example, a receptacle may comprise a pocket in a side of a cover of the mattress, into which the support may slide. As another non-limiting example, a receptacle may comprise a mount on the side of the cover, which may receive and couple to the support.

In further embodiments, an individual who will use the bed may select the location on the bed to which the support may be secured. Such a support may be removable from the bed, which may enable an individual to adjust its location relative to the bed or discontinue its use. Such a support may include a fastener that enables it to be removably secured to a portion of the bed. As an example, the fastener may enable the support to be removably secured to a user-selected location on a mattress of the bed (e.g., on a cover of the mattress, etc.). As another example, the fastener may enable the support to be removably secured to a user-selected location on a bedframe of the bed (e.g., an adjustable bedframe, a fixed bedframe, etc.). As yet another example, the fastener may enable the support to be removably secured to a headboard of the bed.

The support may include a coupler. The coupler of the support may removably engage the cradle; such a coupler may be referred to as a "cradle coupler." Alternatively, the coupler of the support may removably engage the remote control and, thus, be referred to as a "remote coupler." As another alternative, the coupler may have a configuration that enables it to receive and removably engage either a cradle or a remote control.

The coupler of the support may removably secure the cradle and/or the remote control to the bed. The location at which the support removably secures the cradle and/or the remote control to the bed may be accessible to an individual laying on a mattress of the bed. In some embodiments, the coupler of the support may removably secure the cradle and/or the remote control to a mattress of the bed. The coupler of the support may removably secure the cradle and/or the remote control to the mattress through a bed sheet (e.g., a fitted bed sheet, etc.). More specifically, the coupler of the support may engage the cradle and/or the remote control through the bed sheet without damaging the bed sheet.

The support may comprise a wireless charging base, which may be capable of wirelessly charging a battery of the cradle and/or a battery of a remote control held directly by the support or by the cradle. Due to the position of the support on the mattress cover, an electrical cord of such a support may be hidden. For example, an electrical cord may be hidden beneath a bed sheet that covers the mattress, by the mattress cover, within a conduit beneath the mattress cover, or otherwise.

In embodiments where the system includes a cradle, the cradle may be removably securable to the support. A coupler of the cradle may secure the cradle to the support. Accordingly, the coupler of the cradle may be referred to as a "support coupler." The support coupler may engage a complementary cradle coupler of the support through a bed sheet (e.g., a fitted bed sheet, etc.) without damaging the bed sheet.

The cradle may also include a receptacle that receives the remote control. The receptacle may mechanically hold the remote control in place. In some embodiments, the cradle may include a retainer that engages and removably secures a remote control in place relative to (on, in, etc.) the receptacle of the cradle. In a specific embodiment, the retainer may comprise a magnet.

In some embodiments, the cradle may also include a secondary remote system that includes one or more controls for the bed and, optionally, for other items (e.g., lights, music, etc.) in the environment in which the bed is located. More specifically, the secondary remote system of such a cradle may provide remote control over one or more functions of the bed and, optionally, other items in the environment in which the bed is located. In some embodiments, the controls of the secondary remote system may enable an individual to intuitively control (e.g., adjust, control a function of, etc.) the bed or the environment in which the bed is located.

The cradle may comprise a wireless charging base, which may be capable of wirelessly charging a battery of the remote control. An electrical cord of such a cradle may be hidden. For example, an electrical cord may be hidden beneath a bed sheet that covers the mattress, by the mattress cover, within a conduit beneath the mattress cover, or otherwise.

In another aspect, a bed is disclosed. The bed may include a bedframe, a mattress with a mattress cover, a support securable to the mattress, an optional bed sheet, and a remote control that controls a function of at least one of the frame and the mattress.

The bedframe of the bed may comprise an adjustable frame. In such an embodiment, the support may be positioned at a location that remains substantially stationary upon adjustment of the adjustable frame. The remote control may control adjustability of the adjustable frame.

In some embodiments, the remote control may control a function of the mattress, such as a firmness of one or more areas of the mattress, a temperature of one or more areas of the mattress, and/or ventilation provided in association with the mattress. The remote control may control operation of a device associated with the bed and/or one or more devices separate from the bed (e.g., a lamp, a door lock, window blinds, etc.).

The bed may optionally include a cradle that can be received by the support. The cradle may include a receptacle that can receive the remote control. The cradle may also include a secondary control system.

According to another aspect, methods for securing a remote control for use with a bed to the bed are disclosed. Such a method may include securing a support to a mattress of the bed at a location readily accessible to an individual as the individual lays on the bed; positioning a bed sheet over the mattress and the support, and securing the remote control in place relative to the support, on an opposite side of the bed sheet from the support. Optionally, such a method may also include positioning a cradle over the bed sheet and the support, with the support securing the cradle in place through the bed sheet and placing the remote control on or in a receptacle of the cradle.

A method for securing a remote control to a bed may also include use of the remote control. As an example, an individual may retrieve the remote control from a location over the support, use the remote control, and replace the remote control on the bed. The remote control may be used to control one or more functions of the bed, an accessory to the bed, or a device separate from the bed.

In embodiments where the method employs a cradle over the support, controls on the cradle may also be used to control one or more functions of the bed.

The remote control may wirelessly charge as it is in placed over the support; for example, as it is received directly by the support or as it is received by the cradle.

Because of the placement of the support and its ability to secure a remote control in place adjacent to an edge of a mattress, the support may enable an individual to readily locate the remote control. The placement of the support adjacent to the edge of a mattress may also store the remote control at a location where it will be readily accessible by an individual, yet not disrupt the individual's sleep. Such placement of the support may also enable an individual to conceal the remote control and any cradle carrying the remote control. The locations of the support and the remote control may themselves provide some concealment. Further concealment of the remote control may be achieved as the individual makes his or her bed; for example, by placing a bed sheet, a blanket, and/or a bedspread or duvet over the remote control. Thus, the support and an optional cradle may store a remote control in an aesthetically pleasing manner.

Other aspects of the disclosed subject matter, as well as features and advantages of various aspects of the disclosed subject matter, should become apparent to those of ordinary skill in the art through the preceding disclosure, the ensuing description, the accompanying drawings, and the appended claims.

DETAILED DESCRIPTION

Figure 1:
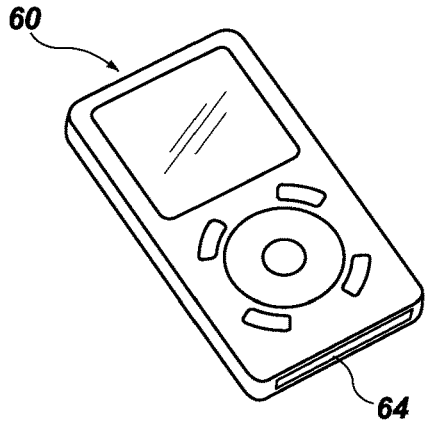
FIG. 1 illustrates an embodiment of a remote control that may be used with a bed.

With reference to FIG. 1, an embodiment of a remote control 60, or a primary remote system, is depicted. The remote control 60 is a dedicated remote control whose use is primarily directed to controlling functions of the bed and accessories, but may also be extended to controlling operation of other devices in proximity to the bed, or in the environment (e.g., a bedroom, etc.) in which the bed is located.

The remote control 60 may control any number of functions associated with a mattress 100 (FIGS. 2-5), the bed of which the mattress 100 is a part, and/or the environment in which the bed is located. Without limitation, the remote control 60 may provide an individual with control over the pressurization (i.e., inflation, deflation, etc.) of bladders of the mattress 100 and/or the orientation of different portions 102 (FIGS. 2-5) of the mattress 100, such as by controlling a power base that supports the mattress 100. In addition, the remote control 60 may enable an individual to control any massage features or vibration associated with the mattress 100. The remote control 60 may also control ambiance in the environment in which the bed is located (e.g., lighting, music, other features). The remote control 60 may also enable an individual to set thermal management of the mattress 100, bed time and/or wake-up routines, and the like. The remote control 60 may even enable integration of the bed with home automation control devices (e.g., those marketed as Google Home®, Alexa®, Apple Homepod®, etc.).

Figure 2:
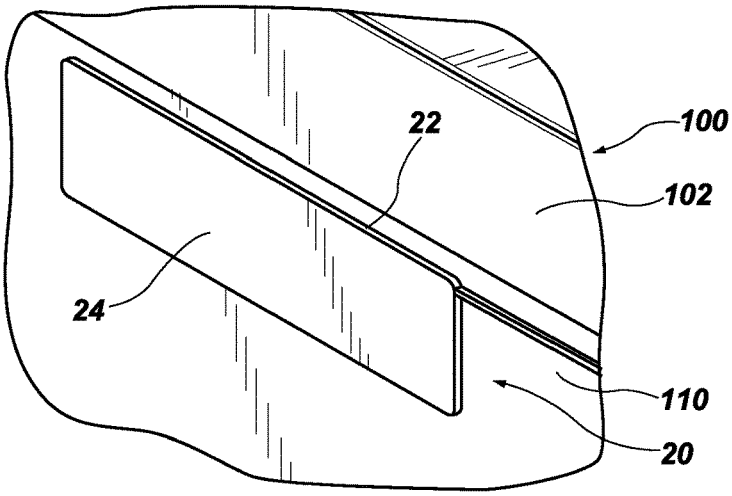
FIG. 2 provides a perspective representation of an embodiment of a support of an apparatus that secures a remote control, such as that depicted by FIG. 1, to a bed, showing the support on a portion of the bed.

Turning now to FIG. 2, an embodiment of a support 20 for a remote control 60 (FIG. 1) is depicted. The support 20 may be secured to a mattress 100 or another part of a bed (e.g., a bedframe, a headboard, etc.). As depicted by FIG. 2, the support 20 may be secured to a side 110 of the mattress 100. The support 20 may be secured to a portion of the side 110 of the mattress 100 that experiences little or no movement with changes to the mattress 100 or to the bed of which the mattress 100 is a part; for example, as an orientation of a corresponding portion 102 (e.g., a head portion, an intermediate portion, a foot portion, etc.) of the mattress 100 is adjusted, as changes in pressurization of the corresponding portion 102 of the mattress 100 occur, or with other changes to the mattress 100 or the bed of which it is a part.

The support 20 may be positioned closer to the head portion **102*h* (FIG. 5) of the side 110 of the mattress 100 rather than closer to the foot portion 102*f* of the side 110 of the mattress 100. The position of the support 20 and, thus, the positioning of the cradle 40 (FIG. 3), if any, and the remote control 60 (FIG. 4) may provide for ready access to the cradle 40 and/or the remote control 60 as an orientation of the mattress 100** is manipulated (e.g., with an adjustable bedframe, or base, etc.).

The support 20 may be permanently affixed to a predetermined location on the mattress 100. Alternatively, the support 20 may be removably securable to one or more predetermined locations on the mattress 100. As another alternative, an individual may select a location on the mattress 100 to which the support 20 is to be removably secured. In any event, the location at which the support 20 is secured to the mattress 100 or elsewhere on the bed may be accessible to an individual laying on the mattress 100.

A fastener 22 may secure the support 20 to the mattress 100 or to any other part of a bed of which the mattress 100 is a part. The fastener 22 may permanently secure the support 20 to a predetermined location on the mattress 100 or another part of the bed, it may removably secure the support 20 to one or more predetermined locations on the mattress 100 or other parts of the bed, or it may removably secure the support 20 to any location on the mattress 100 or the bed selected by an individual who may use a remote control 60 (FIG. 1) that may be held in place by the support 20 or by a cradle 40 (FIG. 3) held in place by the support 20.

In a specific embodiment, the fastener 22 may comprise a so-called "hook fabric" (i.e., the rigid side of a hook-and-loop fastener (e.g., a VELCRO® hook-and-loop fastener, etc.)) on a backside of the support 20, which may be used to removably secure the support 20 to a cover of the mattress 100, with the cover serving as the "loop" side of the hook-and-loop fastener. Such a fastener 22 may facilitate the subsequent removal, repositioning, and/or replacement of the support 20 on a cover of the mattress 100.

Alternatively, the fastener 22 may comprise a magnet.

The support 20 may also include a coupler 24, which may removably engage the cradle 40 (FIG. 3) and/or the remote control 60 (FIG. 1). In some embodiments, the coupler 24 may comprise a magnet (i.e., a so-called "hard" ferromagnetic material that remains magnetized). In other embodiments, the coupler 24 may comprise a ferromagnetic material (i.e., a material that is attracted to a magnetic field, including so-called "soft" ferromagnetic materials that do not remain magnetized and hard ferromagnetic materials that remain magnetized). In other embodiments, the coupler 24 may comprise a latch, which may mechanically engage the cradle 40 and/or the remote control 60.

The support 20 may comprise a wireless charging base (e.g., an inductive charging base, etc.) of a known type. Thus, the support 20 may wirelessly charge a battery of the cradle 40 (FIG. 3) and/or a battery of a remote control 60 (FIG. 1). Due to the position of the support 20 on the mattress cover, an electrical cord of such a support 20 may be hidden. For example, the electrical cord may be hidden beneath a bed sheet that covers the mattress 100, by the mattress cover, within a conduit beneath the mattress cover, or otherwise.

Figure 3:
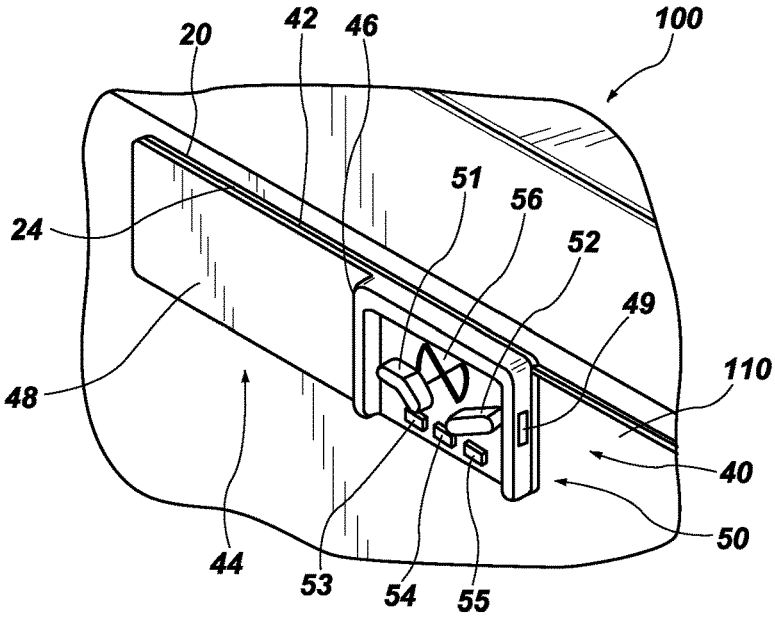
FIG. 3 provides a perspective representation of an embodiment of a cradle that removably couples to the embodiment of support shown in FIG. 2, illustrating an assembly including the support and the cradle on the portion of the bed depicted by FIG. 2.

FIG. 3 shows a cradle 40 secured in place over the support 20 on the side 110 of the mattress 100. A support coupler 42 may secure the cradle 40 to the support 20. The cradle 40 also includes a receptacle 44, which may receive a remote control 60 (FIG. 1) for the bed. In addition, the cradle 40 may include a secondary remote system 50, which may remotely control operation of one or more features of the bed and, optionally, of one or more other items in the environment (e.g., bedroom, etc.) in which the bed is located.

The support coupler 42 of the cradle 40 may engage a complementary coupler 24 of the support 20. In some embodiments, including those embodiments where the coupler 24 comprises a magnet, the support coupler 42 may comprise a ferromagnetic material. In other embodiments, including those embodiments where the coupler 24 of the support 20 comprises a ferromagnetic material, the support coupler 42 of the cradle 40 may comprise a magnet. A strength of the magnetic field generated by a magnetic support coupler 42 may enable it to hold the cradle 40 in place against the support 20, but not so strong as to have an adverse effect on operation of any controls of the secondary remote system 50 or of a remote control 60 (FIG. 1) carried by the receptacle 44 of the cradle 40.

The receptacle 44 of the cradle 40 may removably receive the remote control 60 (FIG. 1). In the embodiment depicted by FIG. 3, the receptacle 44 comprises a relatively flat area on a front of the cradle 40, with at least one raised edge 46 against which an edge 64 (FIG. 1, FIG. 4) of the remote control 60 may be positioned. In other embodiments, the receptacle 44 may include a plurality of raised features (e.g., edges, corners, posts, etc., or combinations thereof) that receive the remote control 60 and optionally retain edges and/or corners of the remote control 60.

In some embodiments, the receptacle 44 may include a retainer 48 that removably engages the remote control 60 (FIG. 1). The retainer 48 may include one or more features (e.g., the raised edge(s) 46, a latch, etc.) that mechanically engage one or more corresponding features of the remote control 60. Alternatively, the retainer 48 may comprise a magnet. A strength of the magnetic field generated by such a retainer 48 may enable it to hold the remote control 60 in place against the receptacle 44 of the cradle 40, but not so strong as to have an adverse effect on operation of the secondary remote system 50 or the remote control 60. In other embodiments, the retainer 48 may comprise a ferromagnetic material (i.e., a material that is attracted to a magnetic field, including so-called "soft" ferromagnetic materials that do not remain magnetized and hard ferromagnetic materials that remain magnetized).

As illustrated by FIG. 3, the optional secondary remote system 50 of the cradle 40 may include controls 51-56 that may enable an individual to intuitively control (e.g., adjust, control a function of, etc.) the mattress 100, the bed of which the mattress 100 is a part, and/or the environment in which the bed is located. The specific embodiment of secondary remote system 50 depicted by FIG. 3 includes a first control 51, a second control 52, a third control 53, a fourth control 54, a fifth control 55, and a sixth control 56. By way of example only, the first control 51 may have a shape and orientation that corresponds generally to the shape and orientation of an upper portion, or a head portion **102*h* (FIG. 5), of the mattress 100 of the bed. The first control 51 may enable an individual laying on the mattress 100 to reach down to a side of the mattress 100, recognize the first control 51 by feel without looking, and adjust an orientation of a head portion of a bedframe of the bed, beneath the head portion 102*h* of the mattress 100, by moving the first control 51 accordingly. In some embodiments, the first control 51 may be used in a manner that enables an individual to set the preselected position of the head portion 102*h* of the mattress 100, such as moving the first control 51 to place the head portion 102*h* in the desired position, and then depressing the first control 51 for a predetermined duration of time (e.g., at least three seconds, etc.) to set the preselected position. Thereafter, the first control 51 may then be depressed a predetermined number of times (e.g., twice or more) to move the head portion 102*h* of the mattress 100** to the preselected position.

A second control 52, which may be positioned next to the first control 51, may have a shape and orientation that corresponds generally to the shape and orientation of a lower portion, or foot portion **102*f* (FIG. 5), of the mattress 100. The second control 52 may enable an individual laying on the mattress 100 to reach down to a side of the mattress 100, recognize the second control 52 by feel without looking, and adjust an orientation of a foot portion of the bedframe of the bed, beneath the foot portion 102*f* of the mattress 100, by moving the second control 52 in one or more directions that correspond to desired movement of a foot portion 102*f* of the mattress 100. In some embodiments, the second control 52 may be used in a manner that enables an individual to set the preselected position of the foot portion 102*f* of the mattress 100, such as moving the second control 52 to place the foot portion 102*f* in the desired position, and then depressing the second control 52 for a predetermined duration of time (e.g., at least three seconds, etc.) to set the preselected position. Thereafter, the second control 52 may then be depressed a predetermined number of times (e.g., twice or more) to move the foot portion 102*f* of the mattress 100** to the preselected position.

A third control 53, a fourth control 54, and a fifth control 55 may be arranged in series beneath the first control 51 and the second control 52, with the third control 53 located beneath the first control 51, the fifth control 55 positioned beneath the second control 52, and the fourth control 54 located between the third control 53 and the fifth control 55 (e.g., beneath adjacent portions of the first control 51 and the second control 52, beneath a gap between the first control 51 and the second control 52, etc.). The third control 53, the fourth control 54, and the fifth control 55 may enable an individual to adjust a firmness of a respective head portion **102*h* (FIG. 5), intermediate portion 102*i* (FIG. 5), and foot portion 102*f* (FIG. 5) of the mattress 100. For example, an individual may press one or more of these controls 53-55 until the corresponding portion 102 of the mattress 100 is inflated or deflated, or pressurized, to a desired pressure. The controls 53-55 may also be used (e.g., in a manner similar to the first control 51 and the second control 52) to set a preselected pressure for each corresponding portion 102 of the mattress 100 and to subsequently pressurize the corresponding portion 102 of the mattress 100 to the preselected pressure (e.g., by depressing the appropriate control 53-55** a predetermined number of times (e.g., twice or more), etc.).

A sixth control 56, which may be located above the first control 51 and the second control 52, may comprise a power button or provide an individual with control over another function of the bed, an accessory, or the environment (e.g., thermal management features, massage features, vibration, lights, etc.).

In some embodiments, the secondary remote system 50 may comprise a remote control. When an individual uses the controls 51-56 of such a secondary remote system 50, the controls 51-56 may generate signals. The signals generated by the controls 51-56 of the secondary remote system 50 of the cradle 40 may be received directly by the bed (e.g., a controller of the bedframe, a controller of or associated with the mattress 100 or a feature thereof, a controller associated with an accessory to the bed, etc.) or by the remote control 60 (FIG. 1), which may then generate and transmit corresponding signals to the controller(s) of the bed, mattress 100, or accessory.

The receptacle 44 of the cradle 40 may optionally comprise a wireless charging base (e.g., an inductive charging base, etc.) of a known type. Thus, the receptacle 44 may wirelessly charge a battery of the remote control 60 (FIG. 1). An electrical cord of a cradle 40 that comprises a wireless charging base may be hidden. For example, the electrical cord may be hidden beneath a bed sheet that covers the mattress 100, by the mattress cover, within a conduit beneath the mattress cover, or otherwise.

In some embodiments, the cradle 40 may include one or more ports 49. Such a port 49 may facilitate wired communication with a controller (not shown) of the secondary remote system 50, if any, of the cradle 40. Such a port 49 may enable electrical power to be communicated to and/or from one or more components of the cradle 40 (e.g., to the secondary remote system 50, if any; to a wireless charging base, if any; to an external device; etc). Without limitation, each port 49 may comprise a USB power port, a USB-c power port, or the like.

Figure 4:
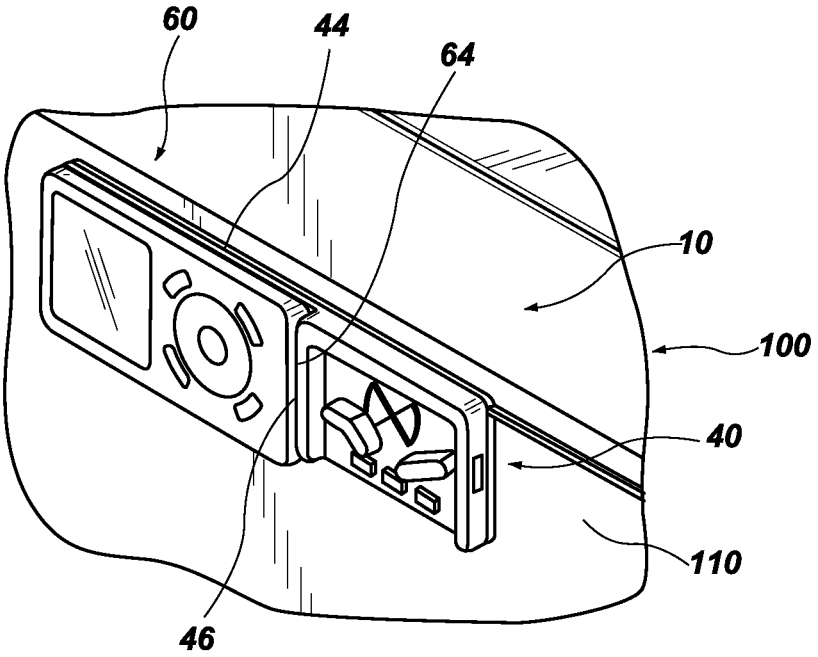
FIG. 4 provides a perspective representation of an embodiment of a remote control that removably couples to the embodiment of cradle shown in FIG. 3, illustrating an assembly including the support, the cradle, and the remote control on the portion of the bed depicted by FIGS. 2 and 3.

FIG. 4 shows a remote control 60 assembled with the cradle 40. More specifically, the remote control 60 has been placed on or in the receptacle 44 of the cradle 40. An edge 64 of the remote control 60 may be positioned against a corresponding raised edge 46 of the cradle 40. The retainer 48 (FIG. 3) of the cradle 40 may hold the remote control 60 in place over or in the receptacle 44. Together, the remote control 60, the cradle 40, if any, and the support 20 (FIGS. 2 and 3) define a system 10 for controlling a mattress 100, a bed of which the mattress 100 is a part, accessories of the bed, and/or devices within an environment in which the bed is located.

Figure 5:
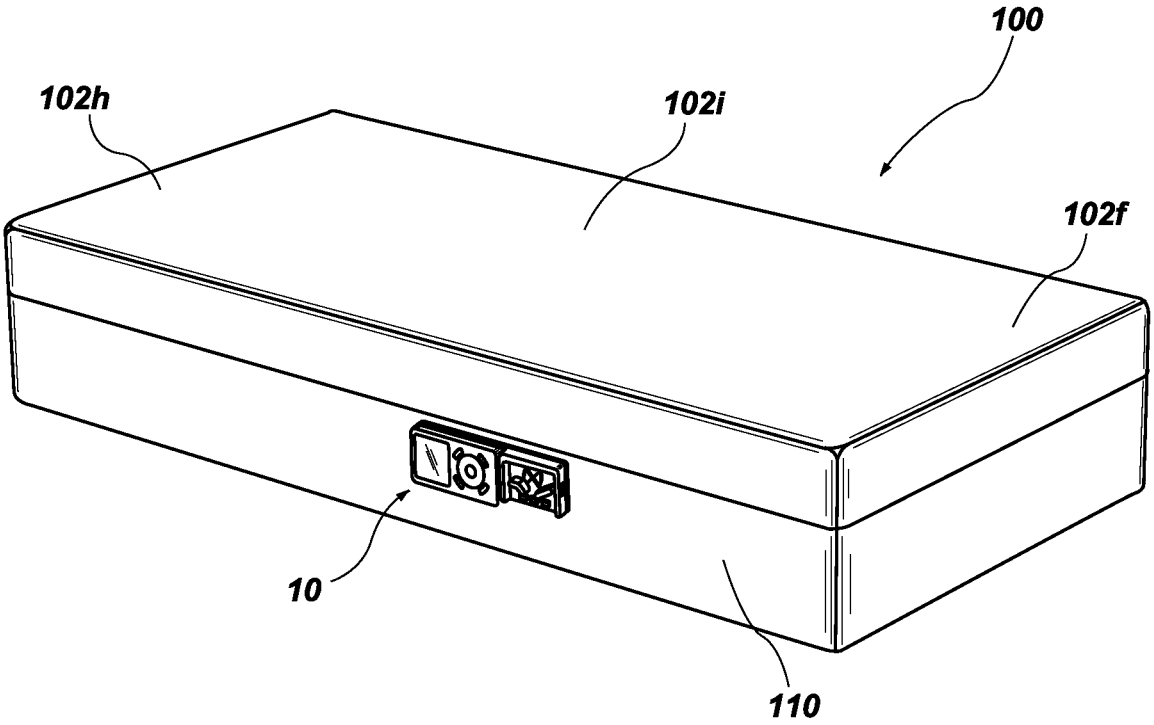
FIG. 5 provides a perspective representation of an embodiment of a bed including the support, the cradle, and the remote control shown in FIG. 4, illustrating an the assembly depicted by FIG. 4 on a side edge of a mattress of the bed.

As depicted by FIG. 5, the system 10 may be positioned at a location and in a orientation on a bed, such as on the side 110 of the mattress 100 of the bed, in a manner that will enable an individual to readily use the system 10 to control operation of the mattress 100, the bed, any accessories associated with the bed, and/or one or more devices within the environment in which the bed is located. Since an individual may manipulate portions 102 of the mattress 100 as he or she sits or lies on the mattress 100, the system 10 and/or its components (e.g., the remote control (FIG. 4), the cradle 40 (FIG. 3), the support 20 (FIG. 2), etc.) may be positioned at a location that is easily reachable/accessible by an individual as he or she uses the mattress 100. While FIG. 5 shows the system 10 and/or its components as being located on a side 110 of an intermediate portion **102*i* of the mattress 100 where it can be readily accessed by an individual's hand as the individual lies on the mattress 100, the system 10 may be located more toward the head portion 102*h* of the mattress 100, closer to a location where the individual's hip, abdomen, or shoulder will be located. However, it will be appreciated that the system 10 and/or its components may be positioned anywhere along the side 110 of the mattress 100**.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A bed, comprising:

a bedframe;

a mattress;

a support fixed to a side panel of the mattress;

a cradle configured to be removably coupled to the support via at least one of a magnet or a hook fabric, the cradle comprising a receptacle and a remote system, the receptacle comprising a retainer, and the remote system comprising at least one control to control at least one of the bedframe or the mattress; and a remote control that controls a function of at least one of the bedframe or the mattress, the remote control receivable by the retainer of the cradle based on the cradle being coupled to the support or by the support when the cradle is decoupled from the support, wherein the remote is supported by the retainer or the support at a location accessible to an individual laying on the mattress.

2. The bed of claim 1, wherein the remote control is receivable by the support through bedding on the mattress.

3. The bed of claim 2, wherein the bedding comprises a mattress cover, a mattress pad, or a bed sheet.

4. The bed of claim 2, wherein the bedding includes an opening that exposes the support.

5. The bed of claim 2, wherein the bedding covers the support.

6. The bed of claim 1, wherein the support is securable to a portion of the mattress that remains substantially stationary upon adjustment of the bedframe.

7. The bed of claim 1, wherein the remote control further controls operation of at least one device separate from the bed.

8. The bed of claim 1, wherein the remote system remotely controls at least one function of the bed.

9. The bed of claim 8, wherein the remote system functions through the remote control.

10. A method for securing a remote control for use with a bed to the bed, comprising:

fixing a support to a side panel of a mattress of the bed at a location readily accessible to an individual as the individual lays on the bed, the support configured to removably receive a cradle via at least one of a magnet or a hook fabric, the cradle comprising a receptacle and a remote system, the receptacle comprising a retainer, and the remote system comprising at least one control to control at least one of a bedframe or the mattress; and receiving the remote control with the retainer of the cradle based on the cradle being coupled to the support or by the support when the cradle is decoupled from the support, wherein the remote is supported by the retainer or the support at a location accessible to the individual laying on the mattress.

11. The method of claim 10, further comprising:

positioning the cradle over the support, the support securing the cradle in place; and securing the remote control to the retainer of the cradle.

12. The method of claim 11, further comprising:

remotely controlling at least one function of the bed with the at least one control of the remote system of the cradle.

13. The method of claim 10, further comprising:

retrieving the remote control from over the support;

using the remote control to control at least one function of the bed; and replacing the remote control over the support.

14. The method of claim 13, wherein using the remote control further comprises using the remote control to control operation of at least one device separate from the bed.

15. The method of claim 10, further comprising:

wirelessly charging the remote control with the support while the remote control is positioned over the support.

16. The method of claim 10, further comprising:

positioning a bed sheet over the mattress and the support.

17. The method of claim 16, wherein receiving the remote control with the support comprises receiving the remote control from an opposite side of the bed sheet from the support.

18. The method of claim 17, wherein receiving the remote control with the support comprises receiving the remote control through an opening in the bed sheet.

19. A support for integrating a remote control for use with a bed into the bed, comprising:

a base fixed to a side panel of a mattress at a location accessible to an individual laying on the mattress, the base including a coupler that receives at least one of:

a cradle configured to be removably coupled to the base via at least one of a magnet or a hook fabric, the cradle including a receptacle and a remote system, the receptacle comprising a retainer, and the remote system comprising at least one control to control at least one of a bedframe or the mattress; and the remote control, wherein the remote control is receivable by the retainer of the cradle based on the cradle being coupled to the base or by the base when the cradle is decoupled from the base.

* * * * *